US006378235B1

(12) United States Patent
Smith

(10) Patent No.: US 6,378,235 B1
(45) Date of Patent: Apr. 30, 2002

(54) WEAPONS REST

(76) Inventor: John W. Smith, P.O. Box 523, Berkeley Springs, WV (US) 25411

( * ) Notice: Subject to any disclaimer, the term of this patent is extended or adjusted under 35 U.S.C. 154(b) by 0 days.

(21) Appl. No.: 09/680,529

(22) Filed: Oct. 6, 2000

Related U.S. Application Data

(60) Provisional application No. 60/188,850, filed on Mar. 13, 2000.

(51) Int. Cl.[7] ..... F41C 29/00; F41C 27/00
(52) U.S. Cl. ..... 42/94; 42/94
(58) Field of Search ..... 42/94; 89/37.04

(56) References Cited

U.S. PATENT DOCUMENTS 3,012,350 A * 12/1961 Wold ..... 42/94
3,935,657 A * 2/1976 Wade ..... 42/94
4,821,443 A * 4/1989 Bianco ..... 42/94
5,233,779 A 8/1993 Shaw
5,332,185 A * 7/1994 Walker, III ..... 42/94
5,875,580 A * 3/1999 Hill et al. ..... 42/94

OTHER PUBLICATIONS

Gun Garage Catalogue 1 Sheet.
Uncle Bud's Catalogue 2 Sheet.
Hops Bench Rests and Sand Bags.
Aimrite Brouchure 2 Sheets.

* cited by examiner

*Primary Examiner*—Peter M. Poon
*Assistant Examiner*—Lulit Semunegus
(74) *Attorney, Agent, or Firm*—Steptoe & Johnson PLLC

(57) ABSTRACT

A weapons rest provided with a pair of sand filled bags having a hinged attachment to a flexible panel which closes upon itself when the bags are moved away from each other.

6 Claims, 1 Drawing Sheet

WEAPONS REST

This application claims priority based on Provisional Application, Ser. No. 60/188,850, filed Mar. 13, 2000 by the applicant herein, namely John W. Smith.

This invention relates generally to devices for supporting weapons while in use. More specifically it relates to improvements in so called "sand bags" upon which one using a rifle or a pistol may support the weapon and have it held securely in place.

BACKGROUND OF THE INVENTION

In the prior art there are numerous devices for supporting a weapon such as a rifle while it is aimed at a target. These devices range from the simple sandbag or metal support to one that attempts to hold a rifle securely. Such a device is shown in the patent to Shaw No. 5,233,779.

Denominated as rifle rests or sandbags these devices when formed from a sturdy fabric are filled with a granular material such as sand. Often they are carried empty to the place of intended use and there filled with sand or other granular material and then rested upon the ground or a bench and the barrel of a rifle supported thereon. To fill the bags, spouts may be provided into which a funnel may be inserted. After filling, the spout may be folded upon itself or sealed in some other way to keep the granular material in the bag.

The purpose of this invention is to provide a novel sandbag or weapon support that, when in use, firmly grips the weapon, be it a rifle or a pistol, thus increasing its accuracy when fired.

Another purpose of this invention is to provide a novel sandbag or weapon support that may be emptied easily or filled easily to facilitate its transport and use without the use of spouts or the like.

SUMMARY OF THE INVENTION

The weapons rest, in one of its embodiments, consists of at least one pair of bags containing sand or other granular material formed with somewhat flat bottoms to rest fixedly on a supporting surface so as to support and grip a weapon resting on top. Means are also provided to easily facilitate their loading and unloading.

DESCRIPTION OF PREFERRED EMBODIMENTS

Figure 1:
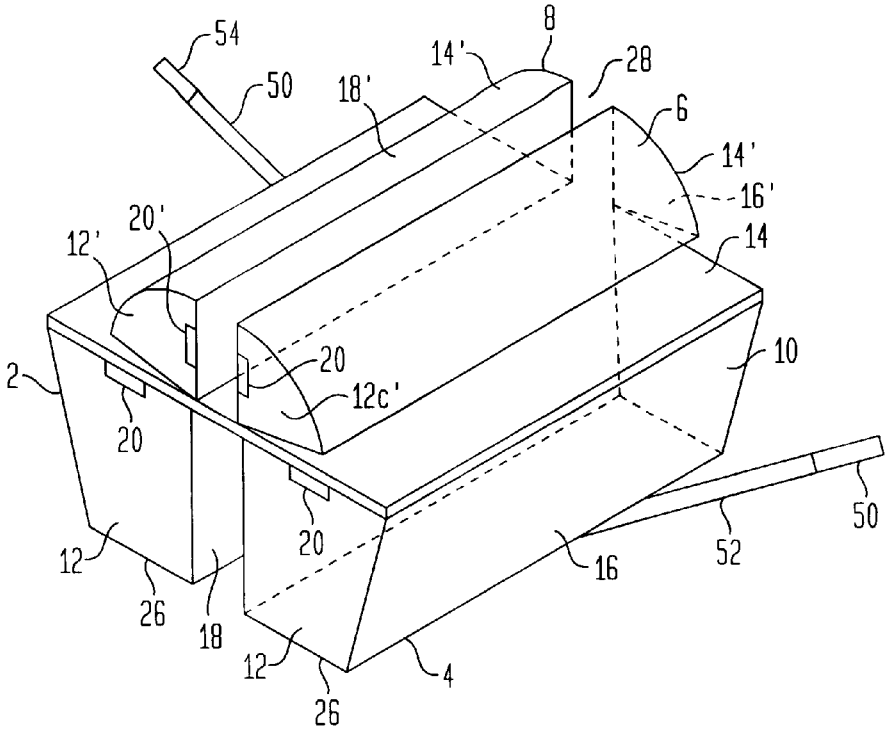
FIG. 1 is a perspective illustration of one embodiment of the invention.
Figure 3:
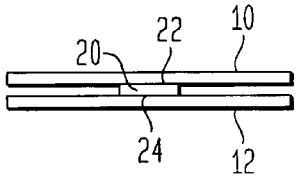

In FIG. 1 the weapons rest comprises four bags, 2, 4, 6 and 8 attached by stitching or adhesive to a relatively thin panel 10. Each bag 2 and 4 comprises a pair of end panels 12 and 14. These are attached to side panel 16 and 18, respectively, for the bags 4 and 2. When the end panels 12 and 14 and the side panels 16 and 18 are attached to the bottom surface of the flat panel 10, the pair of essentially closed bags 2 and 4 are formed. The bags are "essentially" closed except the portions 20. As shown in FIG. 3, these portions are formed with hook and loop segments 22 and 24 which may be pulled apart to provide an opening through which sand or other granular material my be pored to empty or fill the bags. The hook and loop segments may be provided anywhere on the bags where two separate pieces of material touch each other. In this manner easy filling or emptying of the bags is achieved.

One feature of the invention is that the end panels 12 and 14 of the bags 22 are formed with substantially straight bottoms 26 so that when they rest on a supporting surface more than point contact with that surface is achieved. This ensures that the bags will remain where they are placed to provide stability for the weapon.

The bags 6 and 8 are formed similarly to the bags 2 and 4. That is, end panels 12' and 14' are attached to side panels 16' and 18'. However, the end panels 12 and 14 are formed as semi-circles so that when assembled with the side panels the bags 6 and 8 are semi-circular in cross section.

In use, the bags are filled with sand through the hook and loop fastener equipped openings 20. A weapon is placed in the space 28 between the bags 2 and 4 and those bags moved outwardly about their lines of attachment to the flat panel 20. This causes the bags 6 and 8 to move toward each other and to firmly grip the weapon, holding it steady. At the same time because edges 26 are formed with relatively straight bottoms a wide contacting surface with the support is provided to prevent further movement of the weapon rest on the supporting surface.

Straps 50 and 52 are provided on the rest and have confronting hook and loop portions 52 and 54. When the portions 52 and 54 engage each other, a carrying handle is provided.

Figure 2:
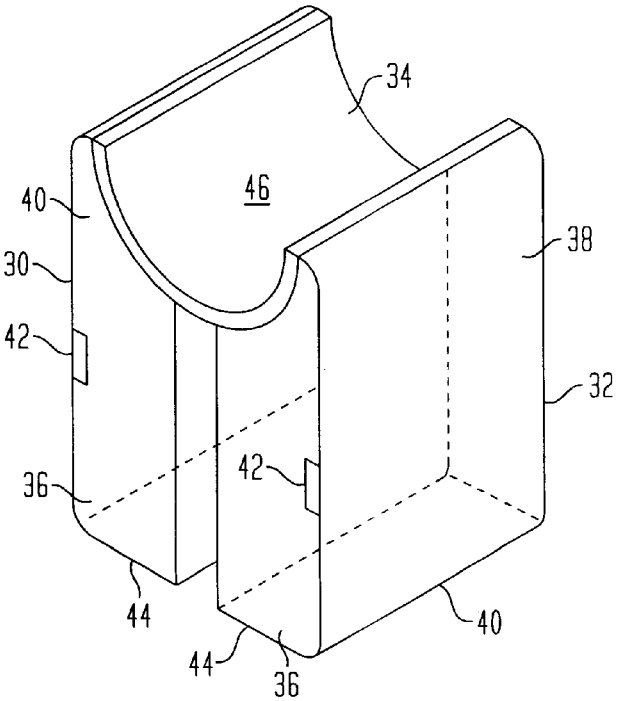
FIG. 2 is a perspective illustration of a second embodiment of the invention; and, FIG. 3 is an illustration of a detail of the invention that may be used in any embodiment of the invention.

FIG. 2 illustrates an alternative embodiment of the invention. In this embodiment the rest has two bags 30 and 32 attached to flat panel 34. End panels 36 and 38 are provided for each bag and are attached to side panels 40 which in turn are attached to the flat panel 34 to form the bags. As before, hook and loop closures 42 are used to facilitate the filling and emptying of the bags.

As may be seen in the drawing, the attachment of the bags to the flat panel 34 is on one side near the center of that panel and on the other side near its ends. The distance from the flat bottoms 44 of the end panels 36 and 38 to the attachment near the center of the panel 34 is less than the distance from that bottom to the ends. This forms the panel 34 into a curved shape forming a space 46 to receive and clamp a weapon.

The structure thus described is one that, when the bags 30 and 32 are moved outwardly the ends of the panel 34 are moved toward each other to clamp the weapon while the bags hold it steady on a supporting surface. Because of the relatively flat bottoms 44, the end panels 36 and 38 form the bags with a wide supporting bottom to maintain them securely in place.

Various changes in the dimensions and design details of the rest, without departing from the scope of the claims appended hereto, and it is intended by the claims to cover all embodiments which come within their scope.

What is claimed as new and desired to be secured by Letters Patent is:

1. A weapons rest comprised of a flexible material, a relatively thin panel, a pair of bags formed from such material, each bag having a narrow upper edge, the narrow upper edge of each bag attached to a lower surface of said relatively thin panel with one of said upper edges opposed to the other of said upper edges and parallel thereto, each bag provided with a closable opening whereby it may be filled with a granular material, whereby when said bags are so filled and their unattached bottoms are moved apart the relatively thin panel bends around the lines of attachment to said bags and its upper surface is folded upon itself to firmly grip a weapon resting thereon while the spaced apart bottoms of said bags are resting on a supporting surface.

2. A weapons rest as set forth in claim 1 including a second pair of bags, each of said bags having a narrow edge the narrow edges of each of said second bags being attached to the upper surface of said relatively thin panel with the narrow edge of one of said second pair of bags attached to and coexistensive with the line of attachment to said lower surface of one of said first pair of bags, and the other of said second set of bags attached to and coexistensive with the line of attachment to said lower surface of the other of said first pair of bags, each of said second pair of bags provided with a closable opening whereby they can be filled with a granular material and whereby when the first set of bags are moved apart along their lines of attachment to the lower surface of said relatively thin panel, said second set of bags move toward each other to clamp a weapon resting between them.

3. A weapons rest as set forth in claim 1 wherein each bag comprises a pair of side panels and an intermediate panel connected between said side panels and provided with ends connected together and attached to said relatively thin panel.

4. The weapons rest of claim 3 wherein each side panel of a bag attached to the lower surface of said relatively thin panel has a bottom edge and edges extending from said bottom edge and said intermediate panel is connected to said bottom and end edges.

5. The weapons rest of claim 4 wherein said bottom edges of said panels are formed in a substantially straight line.

6. The weapons rest of claims 1 or 2 wherein said openings in said bags are provided with hook and loop strips whereby they may easily be opened or closed to fill or empty said bags.

* * * * *